United States Patent [19]

Prieto

[11] Patent Number: 4,726,289

[45] Date of Patent: Feb. 23, 1988

[54] OFFSET PRESS NUMBERING AND PRINTING ATTACHMENT

[76] Inventor: Justo A. Prieto, 1053 Sonora Ave., Glendale, Calif. 90240

[21] Appl. No.: 815,899

[22] Filed: Jan. 3, 1986

[51] Int. Cl.[4] ..... B41F 13/46

[52] U.S. Cl. ..... 101/77; 101/88

[58] Field of Search ..... 101/72, 76, 79, 88

[56] References Cited

U.S. PATENT DOCUMENTS

| | | | |
|---|---|---|---|
| 3,598,044 | 8/1971 | Hutchinson | 101/76 |
| 3,728,960 | 4/1973 | Heath | 101/76 |
| 3,985,073 | 10/1976 | Keller | 101/76 |
| 4,068,582 | 1/1978 | Poitras et al. | 101/76 |
| 4,248,145 | 2/1981 | Patyk et al. | 101/76 |
| 4,369,703 | 1/1983 | Jarach | 101/76 |
| 4,426,929 | 1/1984 | Fujisawa et al. | 101/76 |
| 4,434,715 | 3/1984 | McHenry | 101/76 |
| 4,470,349 | 9/1984 | Godlewski | 101/76 |
| 4,590,858 | 5/1986 | Sedlak et al. | 101/76 |

*Primary Examiner*—William Pieprz

*Attorney, Agent, or Firm*—Albert O. Cota

[57] ABSTRACT

An attachment for an offset press defining a frame (20) having a connection to the press with a series of gears interconnecting with a revolving member on the press. A reservoir (48) and three ink rollers provide a transferable ink surface with adjustable numbering heads (84) or imprinting heads (86) that rotate on a main shaft (38) receiving the ink and transferring it to the paper, as it is discharged from the press. A control system and a method of disconnecting the imprinting is provided utilizing a series of gears and roller mounted lever arms.

8 Claims, 17 Drawing Figures

OFFSET PRESS NUMBERING AND PRINTING ATTACHMENT

TECHNICAL FIELD

This invention relates to accessories for offset lithographic presses in general, and more specifically to an attachment for printing sequential numbers or special imprints.

BACKGROUND ART

Previously, many different approaches have been taken to add ancillary devices to specific lithographic presses. Most of the prior art deals with numbering devices that are actuated by a specific machine, however, a search of the prior art did not disclose any patents that read directly on the claims of the instant invention, nevertheless, the following U.S. patents were considered related:

| U.S. Pat. No. | Inventor | Issue Date |
|---|---|---|
| 4,068,578 | Delligatti | Jan. 17, 1978 |
| 4,055,116 | Roberts et al | Oct. 25, 1977 |
| 3,120,800 | Ward | Feb. 11, 1964 |
| 2,833,209 | Gustafson | May 6, 1958 |
| 2,172,318 | Ferguson | Jan. 17, 1938 |
| 283,016 | Olson | Aug. 14, 1883 |

Delligatti teaches a device that is attached to a conveyer frame that articles, such as boxes or crates, are being conveyed along. The invention is mounted in such a position that the printing wheel is in the path and contacts the article, thereby causing a cam collar to move downward, tripping a spindle on the printing wheel, numbering the article in sequence.

Roberts et al utilizes a designating printer wheel in conjunction with a counter-printer device interchanged with a printer wheel of similar construction. This kit employs a series of gears and toothed elements on shafts to accomplish this function.

Ward practices a binary printer with a decimal display into one frame. An electrical solenoid actuates the device and with each linear stroke, the marked and numbered wheels are sequentially rotated. A roll of inked ribbon passes beneath the guide rollers and imprints the sheet or document.

Gustafson employs a printer that is attached to a record perforating machine dislosed in U.S. Pat. No. 2,647,581. This printer relies upon an electromagnetic solenoid to change the numbering head and mechanical linkage creates the force to imprint the indica on the workpiece.

Ferguson's invention is adapted to various types of packaging and casing machines or conveyers, and uses chains and a printing drum for marking.

For background purposes and as indicative of the art to which the invention relates, reference may be made to the patent issued to Olson.

DISCLOSURE OF THE INVENTION

Although numbering and imprinting attachments have been developed in the past, there has been a need for improvements that allow greater flexibility and are simpler to use and more cost effective. The instant invention fills this need and it is, therefore, a primary object of the invention to provide a device that both sequentially numbers and imprints and will utilize up to 21 numbering heads in simultaneous operation. This apparatus will easily utilize the conventional sequential numbering heads, as well as the skip, repeat, consecutive forward and consecutive backward heads that are presently available expanding the adaptability beyond that of the prior art.

An important object allows easy adjustment of the heads for the desired registration on practically any location of the printed sheet. The adjustment structure is easy to operate and the position of the inking and drive mechanism allows unencumbered access to the working area.

Another object of the invention allows this attachment to be used on a specific family of presses without modification. Compatability is afforded to all MULTILITH Offset duplicators, as manufactured by AM Copier-Duplicator Division of Addressograph Multilith Corporation. It will be noted, however, that presses having accessories already using the attaching area, such as chain deliveries, perforating, slitting, or scoring units, as well as master ejection sorters, etc., will not allow the addition of this unit without removal of the accessory first.

Still another object of the invention is the use of an inking system not unlike that of the press itself. This inking arrangement allows the entire width to be covered, eliminating the necessity of adding more individual pads, such as the felt type now in common use, when employing multiple heads on the opposite sides of the unit. Further, the operator is already required to fill the reservoir on the press and is accustomed to its adjustment and operation, therefore, this object simplifies the application and saves set-up time for the system.

These and other objects and advantages of the present invention will become apparent from the subsequent detailed description of the preferred embodiment and the appended claims taken in conjunction with the accompanyint drawings.

BEST MODE FOR CARRYING OUT THE INVENTION

Figure 1:
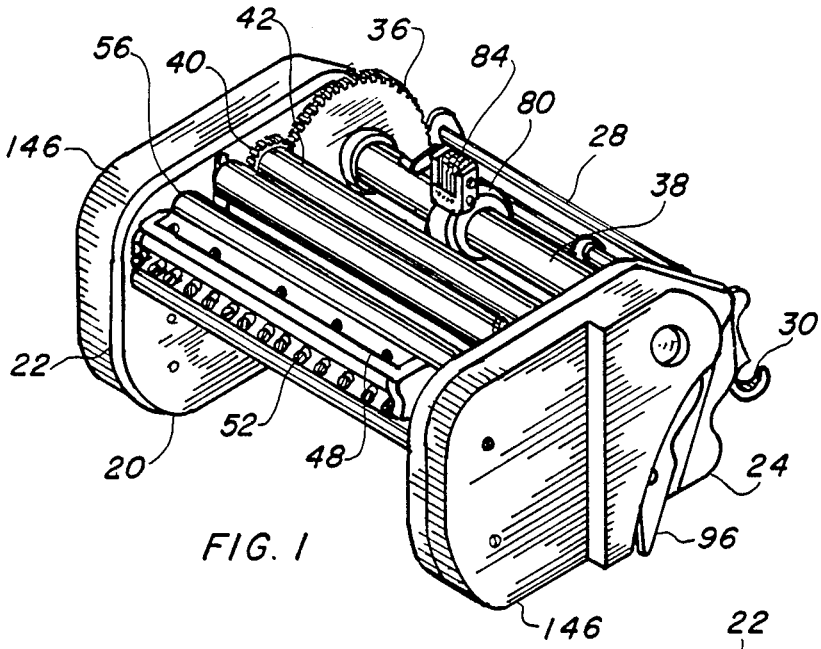
FIG. 1 is a partial isometric view of the preferred embodiment.
Figure 2:
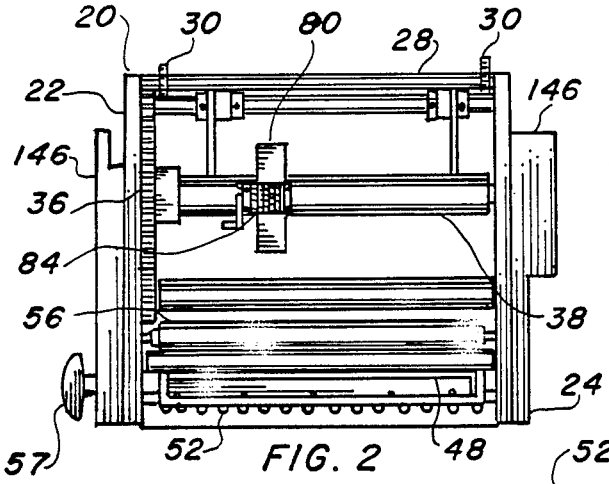
FIG. 2 is a plan view of the preferred embodiment.
Figure 3:
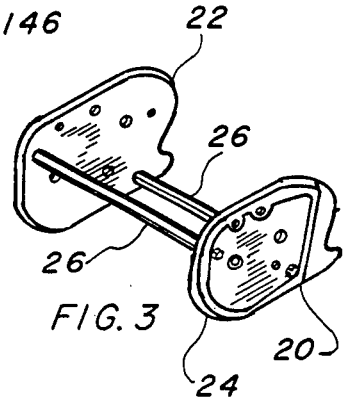
FIG. 3 is a partial isometric view of the frame assembly completely removed from the invention for clarity.
Figure 4:
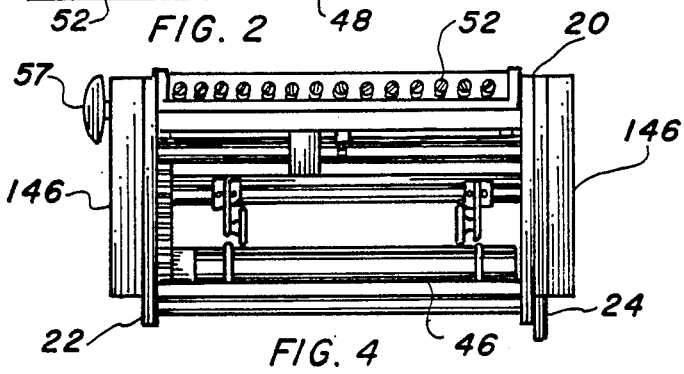
FIG. 4 is an end view of the preferred embodiment.
Figure 5:
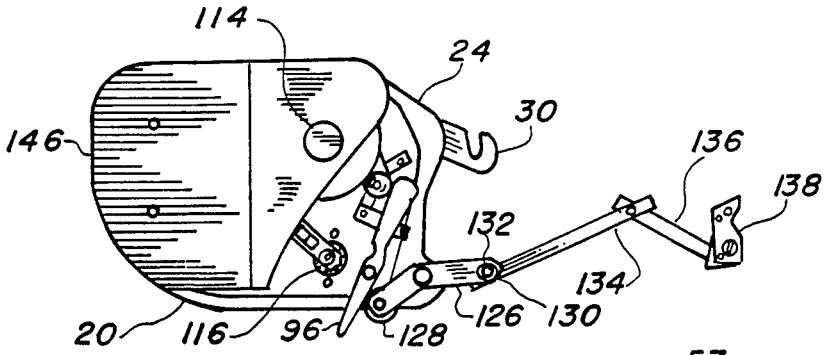
FIG. 5 is a side elevation view of the preferred embodiment.

The best mode for carrying out the invention is presented in terms of a preferred embodiment. The preferred embodiment, as shown in FIGS. 1 through 17 is comprised of a structural frame 20 having a first side 22 and a second side 24 with a pair of spacer bars 26 attaching the sides together. The sides are preferably cast of a ferrous alloy, but may be constructed by other methods and of other materials. A series of raised bosses and holes interface with other elements within the system.

The apparatus is connected to the printing press by means consisting of a rod 28 rotatably disposed between the sides of the frame 22 and 24 creating a structural member upon which a pair of hooks 30 are positioned in a slideable manner. These hooks 30 grasp the rigid structure of the offset press and are movable enough to allow the connection to be easily made.

An ejection roller in the offset press contains a gear at one end and interfaces with the invention providing the rotational force to drive the attachment. A drive gear 32 is attached to the first side of the frame 22 and meshes with the revolving member in the press being the initial member of the drive system. An idler gear 34 is driven by this primary gear 32 and is also attached to the frame 20 in the same manner. This idler 34 is meshed with a much larger main driven gear 36 attached to a main shaft 38, described later. This driven gear 36, in turn, rotates an ink roller gear 40 attached to an imprinting ink roller 42, and finally an impression workpiece roller 46 contains an integral workpiece gear 44. These 5 gears are so sized to synchronize the operation and allow the numbering or imprinting to be controlled at precisely the desired location on the workpiece.

The subsystem to supply ink, or inking means, is located between the frame sides 22 and 24 and provides a transferable ink surface that is replenished with selected synchronized rotation of the drive system. This is accomplished using a multiple adjusted ink reservoir 48, not unlike that found on the offset press. This reservoir 48 has an angular frame 50 with a plurality of adjustment screws 52 and a pressure plate 54 angularly attached on one end to the frame 50 in a pivotally yielding manner.

A reservoir ink roller 56 is attached inside the frame 20 in a rotatable manner with a shaft protruding from each end. The frame 50 is also pivotally mounted upon the shaft between the roller 56 and the frame sides 22 and 24. This arrangement creates a pocket between the roller 56 and the pressure plate 54 in which ink may be stored. The roller 56, further, has the shaft extended on one end beyond the frame 20 and contains a manual handwheel 57. Rotation of this handwheel 57 allows the ink in the reservoir to be coated upon the outside surface of the ink roller 56. The thickness of the ink is determined by the adjustable gap between the roller 56 and the reservoir 48. This gap is controlled by the adjusting screws 52 that are placed in a row through the frame 50 and urge the pressure plate 54 toward the roller 56 when tightened under tension or away from the roller 56 when loosened. In operation, the handwheel 57 is manually turned only occasionally, as a very small amount of ink is required for this type of numbering or imprinting.

An axially swiveling transfer roller assembly is in contact with the roller 56 upon each rotation of the main shaft 38. This assembly consists of a first round bar 60 penetrating through the sides 22 and 24 of the frame defining a pivot point. A pair of biforcated members 62 having unequal height forks are swivelly mounted upon the first round bar 60. The highest fork has a radial groove in the top parallel to the first bar 60. A second round bar 64 penetrates the forks of the members 62 acting as an attachment pin tieing the two bars 60 and 64 together in planar relationship.

A pair of spring loaded fingers 66 attach through the ends of the first round bar 60 where they penetrate the biforcated member 62, captivating them between the forks. These fingers 66 are shaped like a swivel lock and define a round hole when combined with the radial groove in the highest fork while rotating within the confines of the fork and against the spring pressure. This arrangement is pictorially illustrated in FIG. 10. A transfer roller 68 is nested rotatably within the round holes made from the fingers 66 and biforcated members 62 allowing the assembly to be contiguous with the reservoir ink roller 56 and transfer the ink where the two rollers touch, also axially swivel into another position. Removal of this transfer roller 68 is easily accomplished by rotating the fingers 66 away from the forks and lifting from the radial grooves.

The imprinting ink roller 42 having the gear 40 on one end is rotatably positioned between the sides of the frame 20. The roller 42 receives ink from the transfer roller 68 and, as it is driven by the gear, it is in continual rotation, also turning the transfer roller 68, as long as this communication exists. This rotation evenly spreads the ink upon both surfaces in concert.

Figure 12:
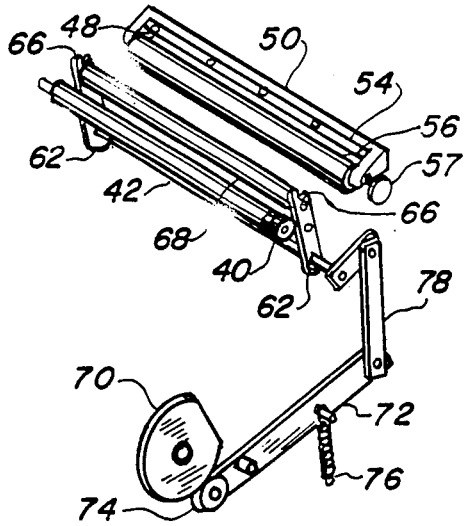
FIG. 12 is a partial isometric view of the inking means with the transfer roller embracing the imprinting ink roller completely removed from the invention for clarity.
Figure 13:
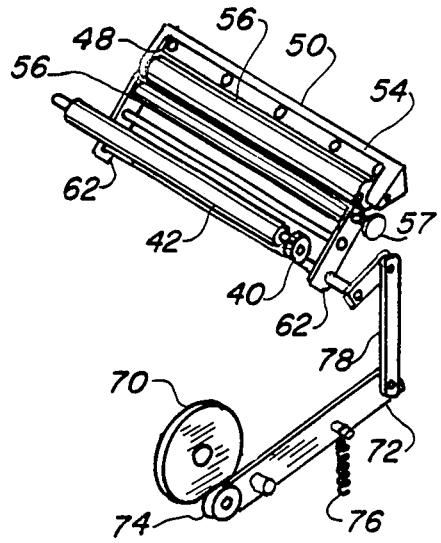
FIG. 13 is a partial isometric view of the inking means with the transfer roller embracing the reservoir ink roller completely removed from the invention for clarity.

In order to shift the ink between the three rollers 6, 68 and 42, a transfer roller positioning mechanism is utilized, shown separately in FIGS. 12 and 13. This mechanism employs an eccentric drive wheel 70 attached onto the end of the main shaft 38 on the outside of the frame 20. A pivotal lever 72 is attached to the frame 20 and has a roller bearing 74 and a spring 76 attached thereto. The spring 76 maintains contact of the bearing 74 onto the wheel 70. This converts the rotational force into linear movement in a pattern established by the shape of the drive wheel 70. A connecting link 78 with an angular offset end is drivingly attached from the pivotal lever 72 to the first round bar 60 of the transfer roller assembly. The first round bar 60 provides the axial movement of the transfer roller 68 from contact with the impregnating ink roller 42 to the reservoir roller 56 allowing transfer of a predetermined amount of ink with each revolution of the eccentric drive wheel 70. This movement then occurs with every imprinting and allows a fresh coating of ink to be available as the imprinting roller 42 turns many times oftener than the main shaft 38. FIG. 12 illustrates the system with the transfer roller 68 in contact with the impregnating roller 42 and FIG. 13 depicts the transfer roller 68 in its momentary contact with the reservoir ink roller 56.

Indica imprinting is accomplished by transferring the ink from the impregnating ink roller 42 to a workpiece, in readable form, when the workpiece is conveyed from an offset press. This operational portion of the apparatus utilizes the impression workpiece roller 46 that is rotatably disposed between the sides of the frame 20 and in alignment with the ejection system of the press. Rotation is supplied by the gear 44, which is in meshed contact with the main driven gear 36. The main shaft 38 is, likewise, positioned into the frame and consists of a round member with a flat on one side and a key on the other, either mounted into a keyway, or mounted on a flat and held in place with threaded fasteners. One end of this shaft 38 is stepped smaller in diameter for attachment of the eccentric drive wheel 70 and the other end is similarly configured. The main drive gear 36 is positioned on the inside of the frame 20 while the eccentric drive wheel 70 is on the outside.

Figure 6:
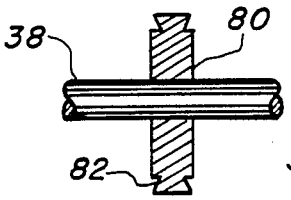
FIG. 6 is a cross-sectional view taken along lines 6—6 of FIG. 9.
Figure 7:
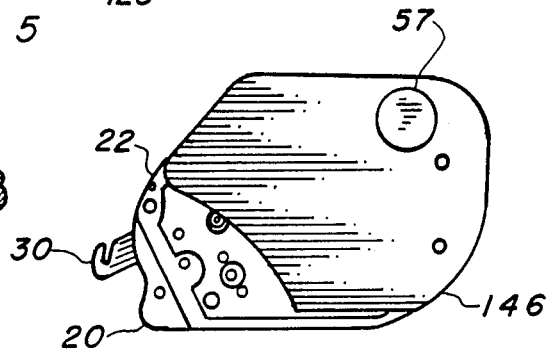
FIG. 7 is a side elevation view of the preferred embodiment.
Figure 8:
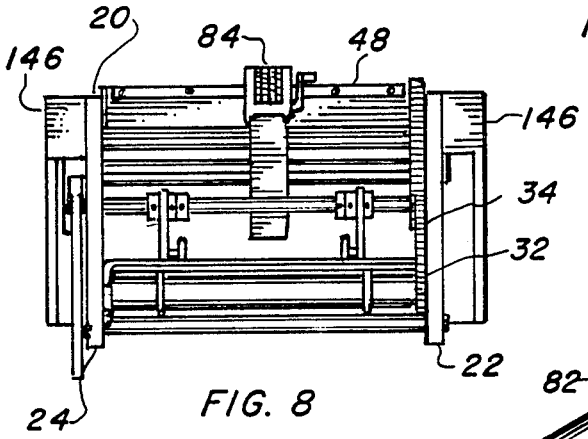
FIG. 8 is a plan view of the preferred embodiment.

One or more mounting rings 80 are movably fastened on the main shaft 38 and each contain a dovetail groove 82, best illustrated in FIG. 6. This dovetail is located near the outside periphery and is the mounting base for a variety of different numbering heads and imprinting devices. As each individual printing job requires a different combination, and location of numbers or imprints, a number of rings 80 may be installed on the shaft 38 to allow this flexibility.

Figure 9:
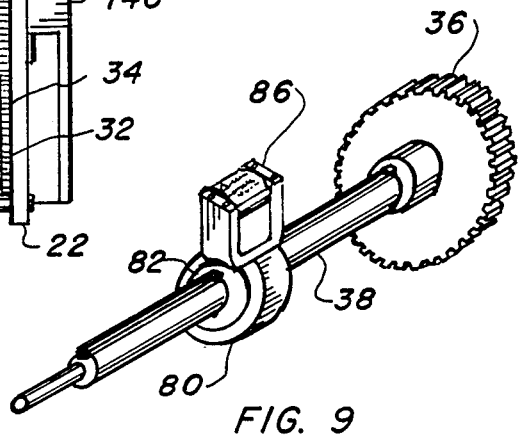
FIG. 9 is a partial isometric view of the main shaft with a numbering head in place removed from the invention for clarity.
Figure 10:
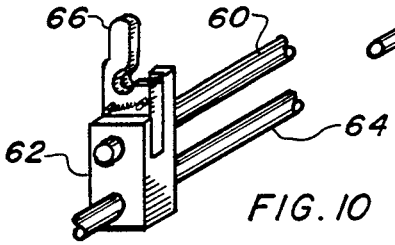
FIG. 10 is a fragmentary partially isometric view of the transfer roller assembly less the roller removed from the invention for clarity.
Figure 14:
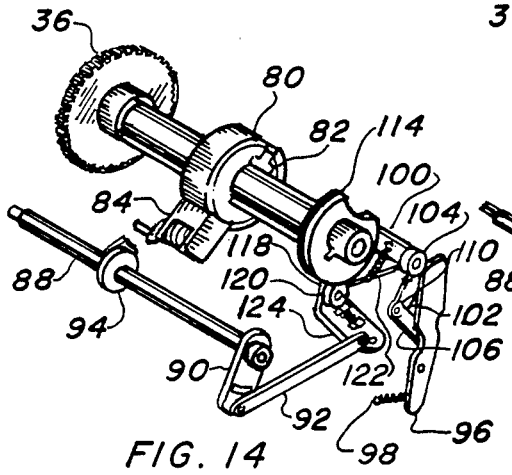
FIG. 14 is a partial isometric view of the imprinting means in the de-energized position completely removed from the invention for clarity.
Figure 15:
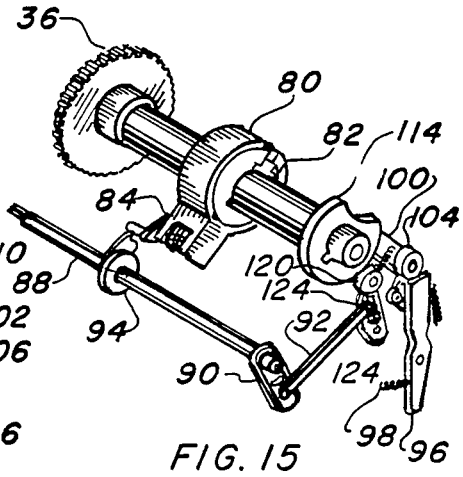
FIG. 15 is a partial isometric view of the imprinting means in the energized position completely removed from the invention for clarity.
Figure 16:
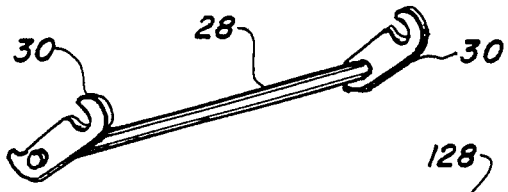
FIG. 16 is a partial isometric view of the press connecting means completely removed from the invention for clarity.

A specific rotary numbering head 84, shown in FIG. 9, is attached into the dovetail groove 82 and is rotated around the ring 80 until the proper location is obtained relative to the desired registration on the workpiece. These numbering heads 84 are easily obtainable and well known in the art and have many variations and combinations. An imprinting head 86 may be substituted or used in combination with the numbering heads 84. An imprinting head contains a specific design, or character, such as a signature, a company logo, or some other pertinent indica of a special nature. These heads 86 are also well known in the art and readily available. There is an operational difference between the numbering heads 84 and the imprinting heads 86 in that the numbering heads require a means to trip the series of numbered wheels that make-up the assembly in order to sequence the impression and the imprinting head does not. This tripping means, illustrated in FIGS. 14 and 15, is accomplished by the utilization of a reset rod 88 that is positioned between the side of the frame 20. One end of this rod 88 has a reset lever 90 attached on the outside of the frame 20 with a reset connecting link 92 attached thereunto. This rod 88 is operated by a separate group of elements discussed in the next few paragraphs of this specification. An appropriate number of tripping fingers 94 are slideably mounted onto the rod 88 to interface with each head. These fingers 94 are so shaped as to have a curved actuation surface that interfaces with a roller on a lever that is part of the head 84. When the rod 88 is rotated in one direction it is in contact, and in another, no contact is made, allowing control of the operation of the numbering head 84 by the rotational direction. To direct the operation of this attachment so that printing may be accomplished without the numbering or imprinting, means for disconnecting this function are provided. Inasmuch as this arrangement of elements is complex, a description of the element will be given and the interrelated function will follow. A pivotal control arm 96 is attached to the outside surface of the second side 24 of the frame 20 and has a radial end on the upper surface and a tension spring 98 attached to the frame 20 on the other.

An arm interrupting angular linkage has a first arm 100 connected on one end to the frame 20 and a second arm 102, connected on one end to the first arm 100, with a roller bearing 104 in between, as part of the joint. A third arm 106 is connected to the frame 20 on one end and the second arm 102 on the other, with a tension spring 108 attached to the frame 20, and a roller bearing 110 distending above the connection of the second arm 102.

An eccentric cam 112 and a wheel having a radial recess 114 are attached in tandum to end of the main shaft 38 on the outside of the frame 20.

A spring loaded roller positioning linkage has an axially adjustable bearing 116 movably attached to the impression workpiece roller 46 at the frame side 24. A first link 118 is attached between the eccentric cam 112 and the radial recessed wheel 114 through the main shaft 38 on one end and has a roller bearing 120 on the other end. A second link 122 is attached to the impression workpiece roller 46 contiguously with the axially adjustable bearing 116 on one end, and slideably to the first link 118 with a compression spring and linkage 124 on the other.

This arm interrupting angular linkage and spring loaded roller positioning linkage provides an interruption of imprinting when the roller positioning linkage is angled away from the press and continues as long as the pivotal control arm 96 is not in contact with the arm angular linkage. This condition is illustrated in FIG. 14. What has happened is that the impression workpiece roller 46, as it is housed within an axial adjustable bearing 116 on one end, is angled away from the numbering or imprinting head 84 and 86, so as to allow the workpiece to freely travel therebetween without touching the printing element at all. Simultaneously, the reset connecting link 92, as it is attached to the second link 122, locates the pivotal control arm 96 away from the press, rotating the tripping fingers 94 out of the way of the numbering head 84.

When the radial end of the pivotal control arm 96 is aligned with the second arm roller bearing 104, the roller positioning linkage springs forward toward the press when alignment occurs with the radial recess of the wheel 114. This condition of operation is shown, removed from the invention, in FIG. 15, and allows the impression workpiece roller 46 to be in alignment with the head 84 or 86 and the pivotal control arm 96 to rotate the fingers 94 into alignment with the numbering head 84.

In order to reset these spring loaded arms and linkage and disengage the system again, the pivotal arm 96 is rotated away from the second arm roller bearing 104 on the arm angular linkage, causing the first link roller bearing 120 to contact the radial recess of the wheel 114. As this wheel 114 rotates, the roller follows the contour of the recess and resets the angle of the roller positioning linkage to the side of the wheel 114 away from the press, again changing the angle of the workpiece roller 46 and tripping fingers 94 to the disengaged position.

Figure 17:
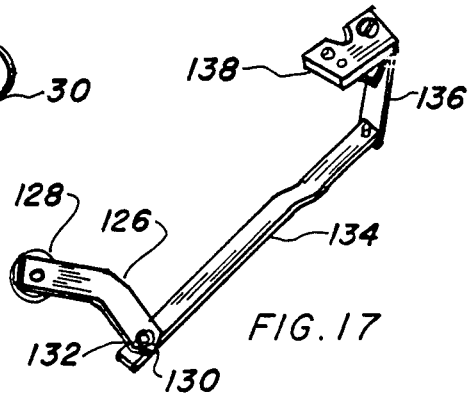
FIG. 17 is a partial isometric view of the extension device completely removed from the invention for clarity.

This regulating of printing is controlled by an extention device, shown in FIG. 17, connected directly to the offset press and moves in sequence with each revolution of the main shaft 38. The extension device has an angular arm 126 with a roller bearing 128 on one end and a pin 130 on the other and a bushing 132 in the middle. An offset link 134 is connected on one end to the pin on the angular arm 126. A stationary arm 136 is connected on one end to the angular arm 126 in a rotatable manner. A double attachment bracket 138 is connected to the stationary arm 136 providing a pivotal attachment link from the offset press to the means for disconnecting the indica printing. When the attachment point on the press linearly moves the extention device, the angular arm roller bearing 128 interfaces with the bottom half of the pivotal control arm 96 on the side nearest to the press. This action allows the arm 96 to function, as described above, with only the roller bearing 128 in actual contact with the attachment.

Figure 11:
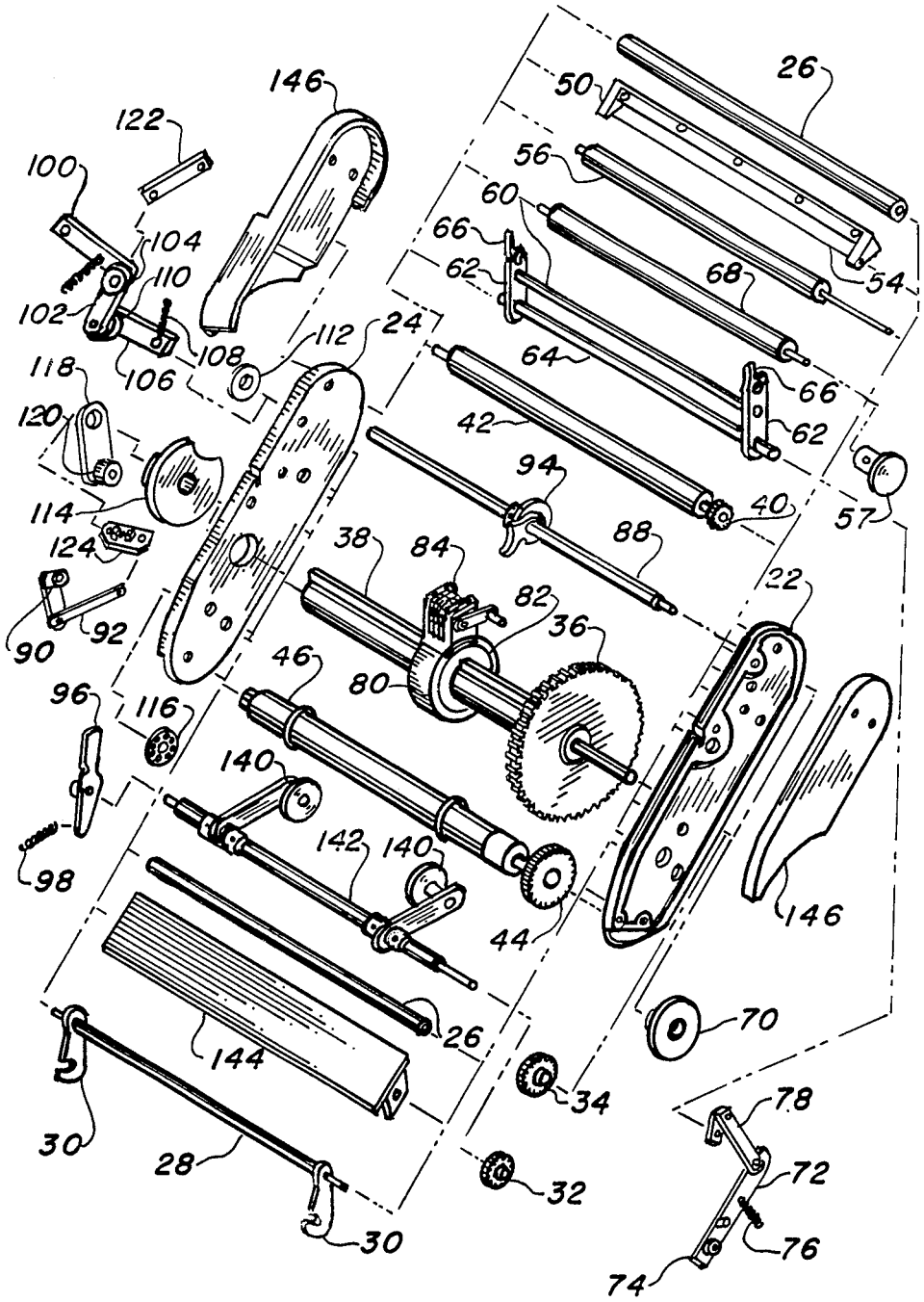
FIG. 11 is an exploded view of the preferred embodiment.

A pair of adjustable weighted wheel positioning guides 140, shown best in FIG. 11, are located between the sides of the frame 20 on a guide rod 142 in alignment and touching the impression workpiece roller 46 for controlling pressure to the workpiece therebetween.

A paper positioning guide 144 is permanently joined, with threaded fasteners, to the inside surface of each side of the frame 22 and 24. This guide 144 is in alignment with the workpiece roller 46 and guides the workpiece to on top of the roller 46 and under the wheel positioning guides 140.

A safety cover 146 is attached on each side of the frame 22 and 24 for protecting an operator from the moving parts thereunder. This cover 146 is made in the same manner as the frame 20 and of the same material.

While the invention has been described in complete detail and pictorially shown in the accompanying drawings, it is not to be limited to such details, since many changes and modifications may be in the invention without departing from the spirit and the scope thereof. Hence, it is described to cover any and all modifications and forms which may come within the language and scope of the appended claims.

I claim:

1. An attachment for an offset lithographic press having a mechanical sensor for printing sequential numbers and imprints comprising:

(a) a structural frame having a first side and a second side with a plurality of spacer bars therebetween;

(b) press connecting means swivelly joined between said frame sides for mounting said attachment to said offest press in a removable manner, having a rod rotabaly disposed between said frame sides creating a structural member, and, a pair of hooks slideably affixed upon said rod in such a manner as to interface with rigid structure of said offset press, (c) rotational drive means disposed within said frame first side interfacing with a revolving member of said offset press providing the rotational force to drive the attachment therewith;

said rotational drive means further comprise: a plurality of intermeshed gears integral with said inking means and indica imprinting means such that when in meshed contact with said offset press, rotational force is transmitted simultaneously from said offset press to said inking means and said indica imprinting means allowing precise movement of elements contained within said frame, (d) inking means affixed between said frame sides and driving connected to said rotational drive means providing a transferable ink surface that is replenished with selected, synchronized rotation of the drive means;

said inking means further comprise:

(1) a multiple adjusted ink reservior having an frame with a plurality of adjustment screws and a pressure plate angularly attached on one end of said reservoir frame in a pivotally yielding manner;

(2) a reservoir ink roller rotatably attached between the sides of said frame and having said ink reservoir pivotally affixed upon each end and an extended shaft protruding beyond said first side of the frame having a manual handwheel mounted therupon for transferring ink from the reservoir to the roller by rotating the roller by hand, as required, supplying a coating upon the surface of the roller of a thickness determined by an adjustable gap between the roller and the reservoir;

(3) an axially swivelling transfer roller having;

a first round bar penetrating through the sides of said frame defining a pivot point, a pair of bifurcated members having unequal height forks, the highest fork further having a radial groove in the top thereof parallel and swivelly mounted upon said first round bar providing a means for mounting of said transfer roller to said frame, a second bar penetrating the said bifurcated members acting as an attachment pin tying said bifurcated members together, a pair of spring loaded fingers attached through said second round bar and contained within each of the forks of said bifurcated member of such a shape as to define a captivating swivel lock, and, a transfer roller nested rotatably within the radial grooves of said bifurcated members and removably captivated by said fingers allowing the roller assembly to be contiguous with said reservior ink roller and transfer the ink where the transfer and ink reservoir ink rollers touch in one position as required, (4) an imprinting ink roller rotatably located between said frame sides with one end having said drive means thereon, the roller receiving ink from said transfer roller and convey it to said indica imprinting means; and, (5) a transfer roller positioning mechanism having;

an eccentric drive wheel attached to said indica imprinting means and said rotational drive means, a pivotal lever having a spring and a roller bearing, the bearing engaging said eccentric drive wheel in such a manner as to convert the rotional force into linear movement in a pattern as established by the shape of the drive wheel, and, a connecting link with an angular offset end drivingly attached from said pivotal lever to said transfer roller assembly first round bar providing axial movement of said transfer roller from contiguous contact with said impregnating ink roller to said reservoir ink roller allowing transfer of a predetermined amount of ink with each revolution of the eccentric drive wheel, (e) indica imprinting means, rotated by said drive means and disposed within the sides of said frame in planar alignment and contiguously engaging said inking means for transferring said ink in readable form upon a workpiece when conveyed from said offset press;

said indica printing means further comprise:

an impression workpiece roller rotatablly disposed between the sides of said frame in alignment with sheets ejected from said offset press and revolved by said rotational drive means, a main shaft positioned between the sides of said frame and connected to said rotational drive means;

a plurality of mounting rings movably fastened upon said main shaft having a dovetail groove on the periphery thereof for attachment purposes, and, a plurality of rotary numbering heads adjustably positioned within the dovetail of said mounting ring having a spaced relationship with said impression roller such when a workpiece is discharged from the offset press and is registered between the head and the impression roller an impression is made upon the workpiece duplication in reverse the indica of the head, and, (f) means for disconnecting the indica imprinting means from contact with a workpiece providing selective control therewith by physically relocating the imprinting means away from the intimate contact of a workpiece processed by said press, said means for disconnecting the indica imprinting further comprise:

(1) a pivotal control arm attached to the second side of said frame having a radial end and a tension spring attached to the frame on the other end;

(2) an arm interrupting angular linkage having, a first arm connected on one end to said frame, a second arm connected on one end to the first arm having a roller bearing inbetween, a third arm connected to the frame on one end and the second arm on the other with a tension spring attached to the frame and a roller bearing distending above the connection of said second arm for controlling interruption of imprinting when said pivotal control arm is rotated to a position impinging on said third arm roller restricting the movement of said arm interrupting angular linkage, (3) an eccentric cam and a wheel having a radial recess attached in tandum to said indica imprinting means on the outside of the second side of said frame, for resetting the disconnecting means;

(4) a spring loaded roller positioning linkage having, an axially adjustable bearing movably attached onto said said indica imprinting means, a first link attached to said main shaft between said eccentric cam and said radial recessed wheel on one end further having a roller bearing on the other end, and, a second link attached contiguously with said adjustable bearing to said workpiece rollers on one end and slideably affixed to said first link through spring compression on the other end with said pivotal control arm fastened rotatably in the middle providing an interruption of imprinting when the roller positioning linkage is angled away from said numbering heads, continuing as long as the pivotal control arm is not in contact with the arm angular linkage, also when the pivotal control arm is aligned with the arm angular linkage the roller positioning linkage springs forward toward the press when alignment occurs with the radial recess of the wheel, and reversal of this action takes place when the pivotal control arm is rotated away from the arm angular linkage causing the bearing on the positioning linkage to contact the radial recess of the wheel rotatably resetting the angle of the positioning linkage to the side of the wheel away from the press.

2. The invention as recited in claim 1 further comprising: numbering head tripping means having, a reset connecting link attached to said means for disconnecting the indica printing, a rest rod position between the sides of said frame and a reset lever on one end attached to said reset connecting link, and a plurality of tripping fingers adjustably attached to said reset rod in such a manner as to interface with said numbering head allowing onset tripping with each rotation of the head in one position and clearance therebetween when said tripping means is repositioned by said connecting link in the other.

3. The invention as recited in claim 1 wherein said means for dissconnecting the indica imprinting further comprise:

(a) a pivotal control arm attached to the second side of said frame having a radial end and a tension spring attached to the frame on the other;

(b) an arm interrupting angular linkage having, a first arm connected on one end to said frame, a second arm connected on one end to the first arm having a roller bearing inbetween, a third arm connected to the frame on one end and the second arm on the other with a tension spring attached to the frame and a roller bearing distending above the connection of said second arm for controlling interruption of imprinting when said pivotal control arm is rotated to a position impinging on said third arm roller restricting the movement of said arm interrupting angular linkage, (c) an eccentric cam and a wheel having a radial recess attached in tandum to said indica imprinting means on the outside of the second side of said frame, for resetting the disconnecting means;

(d) a spring loaded roller positioning linkage having, an axially adjustable bearing movably attached onto said indica imprinting means, a first link attached between said eccentric cam and said radial recessed wheel on one end with a roller bearing on the other end, and, a second link attached contiguously with said adjustable bearing on one end and slideably to said first link through spring compression on the other end with said pivotal control arm fastened rotatably in the middle providing an interruption of imprinting when the roller positioning linkage is angled away from the press, continuing as long as the pivotal control arm is not in contact with the arm angular linkage, also when the pivotal control arm is aligned with the arm angular linkage the roller positioning linkage springs forward toward the press when alignment occurs with the radial recess of the wheel, and reversal of this action takes place when the pivotal control arm is rotated away from the arm angular linkage causing the bearing on the positioning linkage to contact the radial recess of the wheel rotatably resetting the angle of the positioning linkage to the side of the wheel away from the press.

4. The invention as recited in claim 1 further comprising:

a safety cover attached on each side of the frame for protecting an operator from the moving parts thereunder.

5. The invention as recited in claim 1 further comprising:

a pair of adjustable weighted wheel positioning guides located between the sides of the frame on a guide rod touching said imprinting means for controlling pressure of a workpiece to the imprinting means.

6. The invention as recited in claim 1 further comprising:

a paper positioning guide permanently joined to the inside surface of each side of the frame in alignment with said imprinting means for guiding a workpiece into the imprinting means.

7. The invention as recited in claim 1 further comprising: an extension device from the press having, an angular arm with a roller bearing on one end and a pin on the other and a bushing in the middle, an offset link connected on one end to the pin on the angular arm, a stationary arm connected on one end to the angular arm in a rotatable manner, and, a double attachment bracket connected to the stationary arm providing a pivotal attachment link from said offset press to said means for disconnecting the indica imprinting.

8. An attachment for an offset lithographic press having a mechanical sensor for printing sequention numbers and imprints comprising:

(a) a structural frame having a first side and a second side with a plurality of spacer bars therebetween;

(b) press connecting means swivelly joined between said frame sides for mounting said attachment to said offset press in a removable manner, having a rod rotably disposed between said frame sides creating a structural member, and, a pair of hooks slideably affixed upon said rod in such a manner as to interface with rigid structure of said offset press, (c) rotational drive means disposed within said frame first side interfacing with a revolving member of said offset providing the rotational force to drive the attachment therewith;

said rotational drive means further comprise: a plurality of intermeshed gears integral with said inking means and indica imprinting means such that when in meshed contact with said offset press, rotational force is transmitted simultaneously from said offset press to said inking means and said indicia imprinting means allowing precise movement of elements contained within said frame, (d) inking means affixed between said frame sides and drivingly connected to said rotational drive means providing a transferable ink surface that is replenished with selected, synchronized rotation of the drive means;

said inking means further comprise:

(1) a multiple adjusted ink reservoir having an frame with a plurality of adjustment screws and a pressure plate angularly attached on one end of said reservoir frame in a pivotally yielding manner;

(2) a reservoir ink roller rotatably attached between the sides of said frame and having said ink reservoir pivotally affixed upon each end and an extended shaft protruding beyond said first side of the frame having a manual handwheel mounted thereupon for transfering ink from the reservoir to the roller by rotating the roller by hand, as required, supplying a coating upon the surface of the roller of a thickness determined by an adjustable gap between the roller and the reservoir;

(3) an axially swivelling transfer roller having;

a first round bar penetrating through the sides of said frame defining a pivot point, a pair of bifurcated members having unequal height forks, the highest fork further having a radial groove in the top thereof parallel and swivelly mounted upon said first round bar providing a means for mounting of said transfer roller to said frame, a second round bar penetrating of said bifurcated members acting as an attachment pin tying said bifurcated members together, a pair of spring loaded fingers attached through said second round bar and contained within each of the forks of said bifurcated member of such a shape as to define a captivating swivel lock, and, a transfer roller nested rotatably within the radial grooves of said bifurcated members and removably captivated by said fingers allowing the roller assembly to be contiguous with said reservoir ink roller and transfer the ink where the transfer and ink reservoir ink rollers touch in one position as required, (4) an imprinting ink roller rotatably located between said frame sides with one end having said drive means thereon, the roller receiving ink from said transfer roller and convey it to said indica imprinting means; and, (5) a transfer roller positioning mechanism having;

an eccentric drive wheel attached to said indica imprinting means and said rotational drive means, a pivotal lever having a spring and a roller bearing, the bearing engaging said eccentric drive wheel in such a manner as to convert the rotational force into linear movement in a pattern as established by the shape of the drive wheel, and, a connecting link with an angular offset end drivingly attached from said pivotal lever to said transfer roller assembly first round bar providing axial movement of said transfer roller from contiguous contact with said impregnating ink roller to said reservoir ink roller allowing transfer of a predetermined amount of ink with each revolution of the eccentric drive wheel, (e) indica imprinting means, rotated by said drive means and disposed within the sides of said frame in planar alignment and contiguously engaging said inking means for transferring said ink in readable from upon a workpiece when conveyed from said offset press, said indica printing means further comprise:

an impression workpiece roller rotatably disposed between the sides of said frame in alignment with sheets ejected from said offset press and revolved by said rotational drive means, a main shaft positioned between the sides of said frame and connected to said rotational drive means, a plurality of mounting rings movably fastened upon said main shaft having a dovetail groove on the periphery thereof for attachment purposed, and, a plurality of imprinting heads adjustably positioned within the dovetail of said mounting ring having a spaced relationship with said impression roller such when a workpiece is discharged from the offset press and is registered between the head and the impression roller an impression is made upon the workpiece duplicating in reverse the indica of the head, (f) means for disconnecting the indica imprinting means from contact with a workpiece providing selective control therewith by physically relocating the imprinting means away from the intimate contact of a workpiece processed by said press, said means for disconnecting the indica imprinting further comprise:

(1) a pivotal control arm attached to the second side of said frame having a radial end and a tension spring attached to the frame on the other end;

(2) an arm interrupting angular linkage having, a first arm connected on one end to said frame, a second arm connected on one end to the first arm having a roller bearing inbetween, a third arm connected to the frame on one end and the second arm on the other with a tension spring attached to the frame and a roller bearing distending above the connection of said second arm for controlling interruption of imprinting when said pivotal control arm is rotated to a position impinging on said third arm roller restricting the movement of said arm interrupting angular linkage, (3) an eccentric cam and a wheel having a radial recess attached in tandum to said indica imprinting means on the outside of the second side of said frame, for resetting the disconnecting means;

(4) a spring loaded roller positioning linkage having, an axially adjustable bearing movably attached onto said indica imprinting means, a first link attached to said main shaft between said eccentric cam and said radial recessed wheel on one end further having a roller bearing on the other end, and, a second link attached contiguously with said adjustable bearing to said workpiece roller on one end and slideably affixed to said first link through spring compression on the other end with said pivotal control arm fastened rotatably in the middle providing an interruption of imprinting when the roller positioning linkage is angled away from said imprinting heads, continuing as long as the pivotal control arm is not in contact with the arm angular linkage, also when the pivotal control arm is aligned with the arm angular linkage the roller positioning linkage springs forward toward the press when alignment occurs with the radial recess of the wheel, and reversal of this action takes place when the pivotal control arm is rotated away from the arm angular linkage causing the bearing on the positioning linkage to contact the radial recess of the wheel rotatably resetting the angle of the positioning linkage to the side of the wheel away from the press.

* * * * *